US006015329A

United States Patent [19]

Isaksson et al.

[11] Patent Number: 6,015,329

[45] Date of Patent: Jan. 18, 2000

[54] TOY VEHICLE LOGGING MILL ACCESSORY

[75] Inventors: Will Isaksson, New York, N.Y.; Donald Edward Toht, Wheaton; Jeffry Han Katz, Chicago, both of Ill.

[73] Assignee: Learning Curve International Inc., Chicago, Ill.

[21] Appl. No.: 09/014,500

[22] Filed: Jan. 28, 1998

[51] Int. Cl.[7] ..... A63H 33/30; B23D 25/00; B65F 5/00

[52] U.S. Cl. ..... 446/424; 446/145; 83/437.5; 414/364; 414/365; 414/366

[58] Field of Search ..... 446/145, 424, 446/427, 428, 435; 83/373, 426, 437.5; 414/359, 360, 362, 364, 365, 366, 368

[56] References Cited

U.S. PATENT DOCUMENTS

| | | | |
|---|---|---|---|
| Re. 8,150 | 4/1878 | Lamb . | |
| 14,757 | 4/1856 | Alexander | 83/426 |
| 286,357 | 10/1883 | Wilkin | 83/426 |
| 1,079,697 | 11/1913 | Flett | 269/61 |
| 2,290,844 | 7/1942 | Smith | 446/427 |
| 2,373,271 | 4/1945 | Smith . | |
| 2,411,228 | 11/1946 | Poulsen | 414/648 |
| 2,581,201 | 1/1952 | Pettit . | |
| 2,914,885 | 12/1959 | Milligan | 446/145 |
| 2,934,853 | 5/1960 | Smith et al. | 446/424 |
| 3,054,214 | 9/1962 | Smith et al. | 446/145 |
| 3,744,793 | 7/1973 | Thompson | 446/145 |
| 3,926,086 | 12/1975 | Crane | 83/801 |
| 4,177,704 | 12/1979 | Randle | 83/435.1 |
| 4,539,877 | 9/1985 | Stevenson | 83/731 |

FOREIGN PATENT DOCUMENTS

| | | |
|---|---|---|
| 2241903 | 1/1991 | United Kingdom . |
| WO 95/12444 | 5/1995 | WIPO . |

*Primary Examiner*—Robert A. Hafer
*Assistant Examiner*—Laura Fossum
*Attorney, Agent, or Firm*—Wallenstein & Wagner

[57] ABSTRACT

A toy vehicle set accessory is claimed. The toy vehicle set accessory comprises a dumper station for removing a toy log from a toy vehicle. A saw mill is positioned substantially adjacent the dumper station. The saw mill receives a toy log from the dumper station and separates the toy log into two distinct pieces.

15 Claims, 3 Drawing Sheets

TOY VEHICLE LOGGING MILL ACCESSORY

TECHNICAL FIELD

The present invention relates generally to toy vehicle track accessories and, more particularly, to a toy logging mill assembly for inclusion in a toy vehicle railway system.

BACKGROUND

In the toy vehicle industry, small toy trains are often run on wooden tracks. These railway systems are designed to grow with the child. In other words, railway configurations can range from very simple ovals to complex systems incorporating bridges, buildings, tunnels, and towns. Many other accessories are available as well such as: toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level. One of the most important aspects of these railway systems is that the track sections be interchangeable. Accordingly, most track sections include male and/or female connectors at opposing ends. This allows the track sections to be connected end to end in a variety of configurations. Adding to the interchangeability of the track sections is the fact that these track sections are usually reversible having rails impregnated on both sides.

In addition, designers are constantly seeking to impart realism to the toy railway systems. In order to do this, designers have sought to introduce miniature accessories that resemble their real life counterparts. For example, locomotive turntables, highway crossings, lighthouses, tunnels, engine sheds, platform stations, draw bridges, windmills, and locomotive roundhouses are but a few of the many accessories available to add realism to the toy railway systems.

In particular, designers have discovered that children enjoy playing with accessories that have moving parts and/or produce sounds. Accordingly, many of the accessories currently available include movable parts such as levers, rotational handles, lifting mechanisms, and the like. Other accessories produce sounds. These include toy tracks that are designed to reproduce the sound an actual locomotive makes as it travels on actual train tracks, and locomotive whistles.

Thus, toy designers are always seeking to improve toy railway systems by introducing novel and interesting accessories which will capture a child's imagination.

SUMMARY OF THE INVENTION

The present invention provides a novel accessory for a toy vehicle railway system. The accessory includes a dumper station and a saw mill. The dumper station is provided to remove cargo from a loaded toy vehicle. The dumper station includes a pivotable track portion. The pivotable track portion has a leading edge and a trailing edge. The dumper station further includes a means for pivoting the track portion about an axis. The means for pivoting rotates the track portion about a pivot axis which is located above the track portion.

The saw mill is designed for separating a toy log into two separate pieces. The saw mill comprises a mill housing having a log receiving end and a cutting end. A saw member is positioned at the cutting end of the housing. The saw mill further comprises a means for providing relative transverse movement to the log from the log receiving end toward the cutting end.

Other advantages and aspects of the present invention will become apparent upon reading the following description of the drawings and detailed description of the invention.

DETAILED DESCRIPTION

Figure 1:
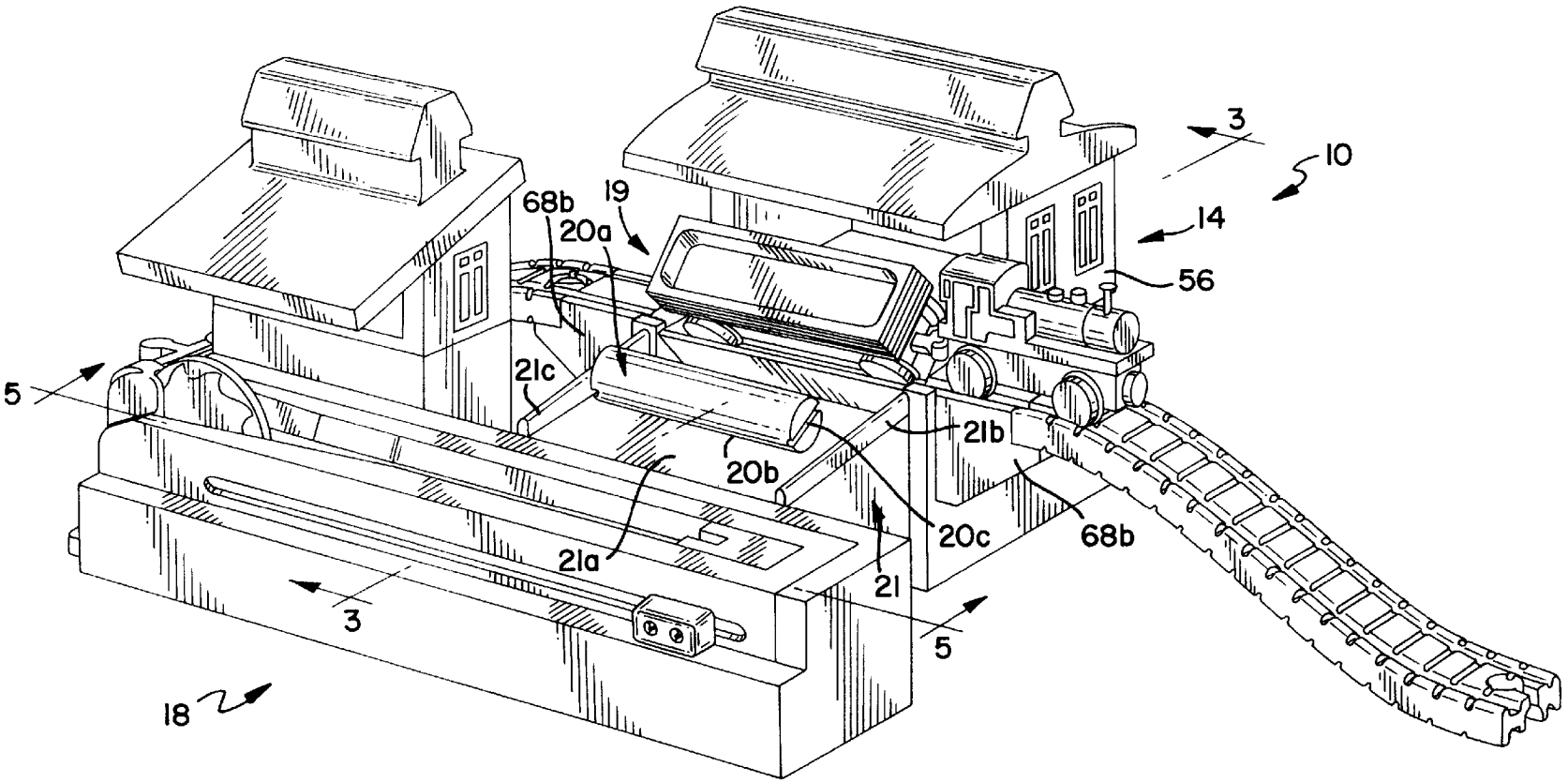
FIG. 1 is a perspective view of a toy vehicle set accessory.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to FIG. 1, a toy vehicle set accessory 10 of the present invention is illustrated. The accessory 10 is devised to be incorporated into a toy vehicle railway system. This accessory 10 comprises a dumper station 14 and a saw mill 18. The dumper station 14 is designed for removing cargo from a toy vehicle. The saw mill 18 is designed for receiving a toy log 20 from the dumper station 14 and separating the toy log 20 into two pieces.

In the embodiment illustrated in FIG. 1, the toy log 20 is out-of-round and is transferred from the toy vehicle 19 along a delivery ramp 21. The shape of the toy log 20 and the length of the delivery ramp 21 cooperate to deliver the toy log 20 to the saw mill 18 in a properly oriented position.

The toy log 20 is designed so that it may be divided into two separate pieces by the saw mill 18. Accordingly, the toy log 20 is chamfered on opposing ends and comprises separable first and second log members 20*a*, 20*b*. The first and second log members 20*a*, 20*b* are joined such that they are separable along a sectioning plane 20*c*. In the preferred embodiment, the first and second log members 20*a*, 20*b* are separably joined by opposing magnets located adjacent the sectioning plane 20*c* and connected to the first and second log members 20*a*, 20*b*. The opposing magnets are separated by spacers which extend from the first and/or second log members 20*a*, 20*b*.

The delivery ramp 21 has an angled portion 21*a* which allows the toy log 20 or any cargo to roll toward the saw mill 18 or other toy railway accessory when the cargo is removed from the toy vehicle 19. The delivery ramp 21 further comprises retaining walls 21*b*, 21*c*. The retaining walls 21*b*, 21*c* are provided to maintain the position of the cargo on the delivery surface 21*a*. The dimensions of the delivery ramp 21 are chosen to insure that the cargo is delivered properly. The height and pitch of the delivery ramp 21 are designed so that the delivery ramp may be used to transfer the cargo from the dumper station 14 to another toy railway accessory, toy vehicle, or the like positioned below the dumper station 14. In particular, the angled portion 21*a* has a pitch. This pitch can vary, but is generally 1° to 15°, more preferably 4° to 6°, and most preferably 4.2°, or any range or combination of ranges. In addition, the length of the angled portion 20*a* can vary as well, but it generally measures 70 mm to 80 mm, more preferably 72 mm to 78 mm, and most preferably 75.2 mm, or any range or combination of ranges therein.

Figure 2:
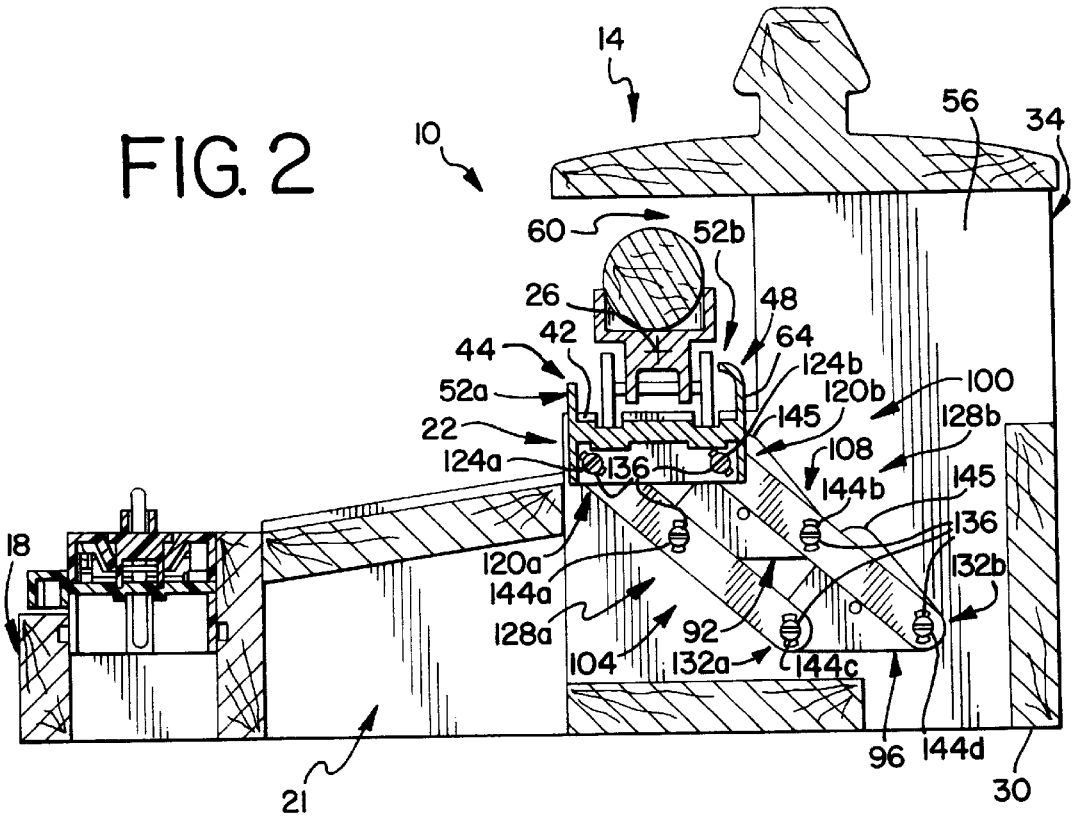
FIG. 2 is a cut away side view along 3—3 of FIG. 1.

Referring to FIG. 2, a cut away side view of a dumper station 14 of the present invention is illustrated. The dumper station 14 comprises a pivotable track portion 22 and a means for pivoting the pivotable track portion 22 about a pivot axis 26. The pivotable track portion 22 is elevated above a baseline 30 by a housing 34. Rails are formed on a track surface 42 of the pivotable track portion 22 to allow toy vehicles to traverse its length. The length of the pivotable track portion 22 corresponds roughly to the length of the toy vehicle used in conjunction with the toy railway system. This permits one toy vehicle to be resting on the pivotable track portion 22 at a given time.

The pivotable track portion 22 also includes a leading edge 44 and a trailing edge 48. The leading edge 44 is generally the edge of the pivotable track portion 22 nearest to the saw mill 18. The leading edge 44 and the trailing edge 48 each have toy vehicle retaining guards 52*a*, 52*b* extending in an upward direction from the track surface 42. The retaining guards 52*a*, 52*b* prevent the toy vehicle from tumbling off the pivotable track portion 22 as the pivotable track portion 22 is rotated to spill the cargo from the toy vehicle. In addition, the retaining guards 52*a*, 52*b* prevent the user from damaging the dumper station by activating the pivotable track portion 22 when a toy vehicle is positioned incorrectly on the pivotable track portion 22. If for any reason a toy vehicle incorrectly straddles the pivotable track portion 22, and the pivotable track portion 22 is rotated, the retaining guards 52*a*, 52*b* flex causing the toy vehicle to be released from the pivotable track portion 22 without causing damage to the dumper station. Thus, the toy vehicles will not bind against the dumper station and damage to the dumper station will be averted.

The housing 34 comprises a pair of parallel opposing housing sidewalls 56. The housing sidewalls 56 include L-shaped notched portions 60 having rails formed on one leg 64. The rails of the L-shaped notched portions 60 are in alignment with the rails formed on the pivotable track portion 22.

Adjacent the L-shaped notched portions 60 are ramped portions 68*a*, 68*b*. (See FIG. 1). The ramped portions 68*a*, 68*b* are fixed to the housing sidewalls 56 and have rails formed on them as well. The ramped portions 68*a*, 68*b* allow toy vehicles to enter and exit the pivotable track portion 22. At free ends, the ramped portions 68*a*, 68*b* have male or female track connectors so that the dumper station 14 can be attached to other toy vehicle track segments and incorporated into a toy railway system.

The means for pivoting the track portion 22 about a pivot axis 26 is designed so that the toy vehicle can be rotated in a clockwise or counterclockwise motion. This means for pivoting rotates the pivotable track portion 22 so that the pivotable track portion 22 rotates about its pivot axis 26 located above the track surface 42 of the pivotable track portion 22. (See FIG. 3). As illustrated in FIG. 2, the pivot axis 26 of the preferred embodiment corresponds to the height above the track surface 42 at which a toy vehicle is coupled to another toy vehicle. In other words, the pivot axis 26 is aligned with the coupling that joins two toy vehicles. This aspect of the invention allows the couples which join two or more toy vehicles to remain axially stable above the baseline 30 when cargo is being unloaded, i.e., the toy vehicle to be unloaded rotates about its coupling system. This is important because when the toy vehicles are joined using a magnetic couple or other similar rotatable coupling device, the toy vehicles remain coupled while one toy vehicle, positioned on the track surface 42, has its cargo unloaded.

The means for pivoting the track portion 22 about a pivot axis 26 generally includes a pair of upper plates 92, a pair of lower plates 96, a pair of beam members 100 each having a proximal arm 104 parallel to a distal arm 108, and a lever (not shown in the drawings). This structure allows the operator to simply flip the lever to unload a toy vehicle. When the lever is turned, the track portion 22 pivots smoothly to unload the toy vehicle.

Each beam member 100 includes a proximal arm 104 in parallel relationship with a distal arm 108. The proximal 104 and distal arms 108 are similar in that each comprises a first end 120*a*, 120*b* having a connection pin 124*a*, 124*b* for joining the proximal 104 and distal arms 108 to the pivotable track portion 22, an intermediate portion 128*a*, 128*b*, and a second end 132*a*, 132*b*. The intermediate portions 128*a*, 128*b* and the second ends 132*a*, 132*b* each define apertures 136.

The connection pins 124*a*, 124*b* are arranged for connection to the pivotable track portion 22. The connection pins 124*a* at the first ends 120*a* of the proximal arms 104 are used to join the proximal arms 104 to the leading edge 44 of the pivotable track portion 22. The connection pins 124*b* at the first ends 120*b* of the distal arms 108 are used to join the distal arms 108 to the trailing edge 48 of the pivotable track portion 22. These connections allow for transfer movement from the upper 92 and lower 96 plates to the pivotable track portion 22.

Each upper plate 92 has a pivot peg (not shown) and a pair of connector pegs 144*a*, 144*b*. The upper plates 92 can be any shape; however, in the preferred embodiment, the upper plates 92 are triangular. The pivot pegs are located at an apex 145 of each upper plate 92 on the opposite side of each upper plate as the connector pegs 1441, 144*b*. The purpose of the pivot pegs is to join the upper plates 92 with the housing sidewalls 56 in such a way as to allow the upper plates 92 to rotate about the pivot pegs.

Figure 3:
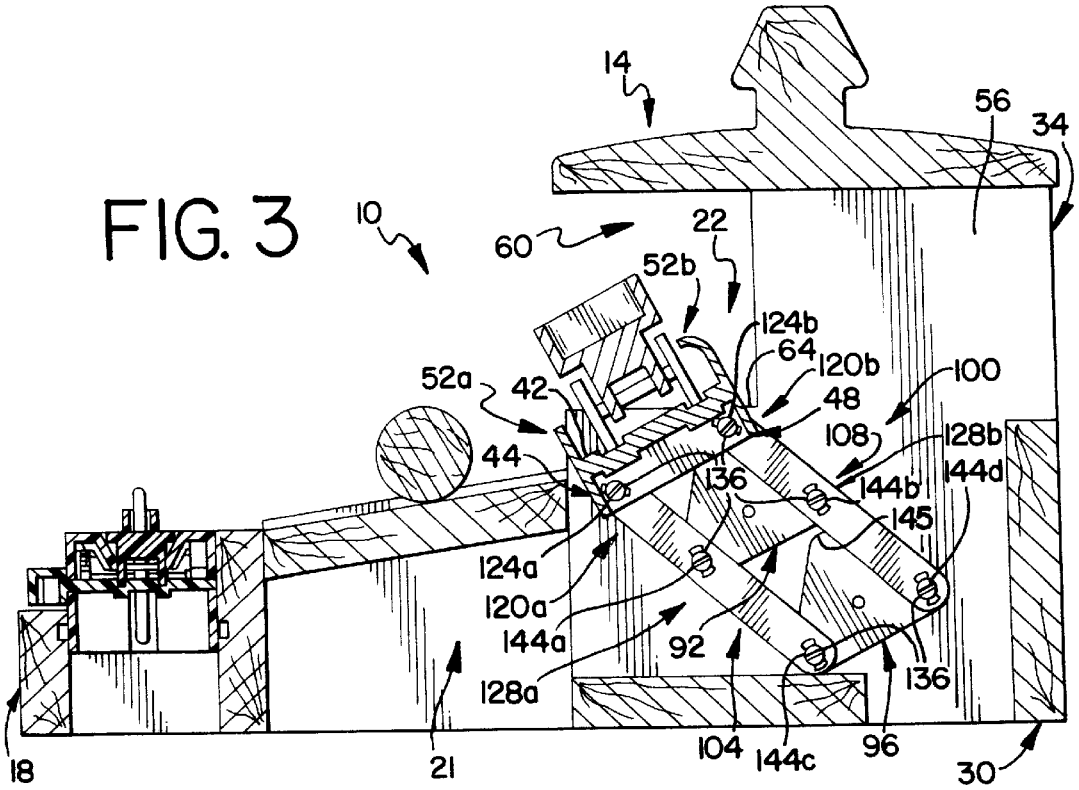
FIG. 3 is a cut away side view of an embodiment of the present invention.

In an alternative embodiment illustrated in FIG. 3, the pivot pegs are located near the center of the upper 92 and lower plates 96. However, in the preferred embodiment, the pivot pegs are located at an apex of the upper 92 and lower 96 plates, and the plates rotate about those points.

The connector pegs 144*a*, 144*b* are positioned at the remaining corners of the upper plates 92. The connector pegs 144*a*, 144*b* join the upper plates 92 with the intermediate segments 128*a*, 128*b* of the proximal 104 and distal arms 108 by cooperatively engaging the apertures 136 defined by the intermediate segments 128*a*, 128*b*. The union of each respective connector peg 144*a*, 144*b* with each intermediate segment 128*a*, 128*b* allows for relative rotational movement between the upper plates 92 and the proximal 104 and distal arms 108.

The lower plates 96 are identical to the upper plates 92. Accordingly, each lower plate 96 has a pivot peg and a pair of connector pegs 144*c*. 144*d*. The apex 145 of each lower plate 96 includes a pivot peg. The pivot pegs join the lower plates 96 with the housing sidewalls 56 in such a way as to allow the lower plates 96 to rotate about the pivot pegs.

The connector pegs 144*c*, 144*d* are positioned at the remaining corners of the lower plates 96. The connector pegs 144*c*, 144*d* join the lower plates 96 with the second ends 132*a*, 132*b* of the proximal 104 and distal arms 108 by cooperatively engaging the apertures 136 defined by the second ends 132*a*, 132*b*. The union of each respective connector peg 144*c*, 144*d* with each second end 132*a*, 132*b* allows for relative movement between the lower plates 96 and the proximal 104 and distal arms 108.

The lever (not shown) includes a neck which passes through an opening in one of the housing sidewalls 56. This neck is fixedly connected to one of the lower plates 96. Therefore, as the lever is turned, it imparts rotational movement to the lower plate driving the proximal 104 and distal arms 108 which in turn rotate the upper plates 92 and the pivotable track portion 22. The rotation of the pivotable track portion 22 dumps the cargo from a loaded toy vehicle.

Figure 4:
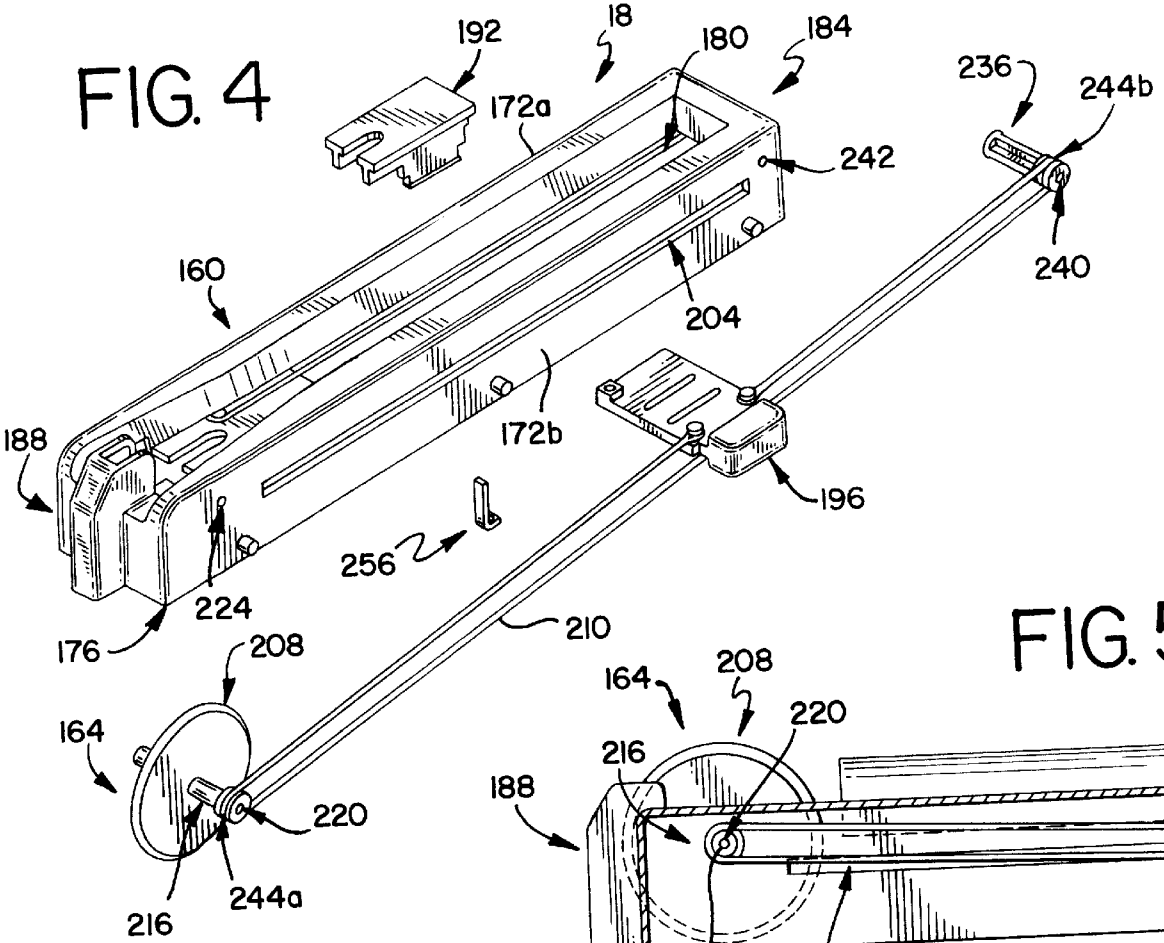
FIG. 4 is a perspective view of a saw mill.
Figure 5:
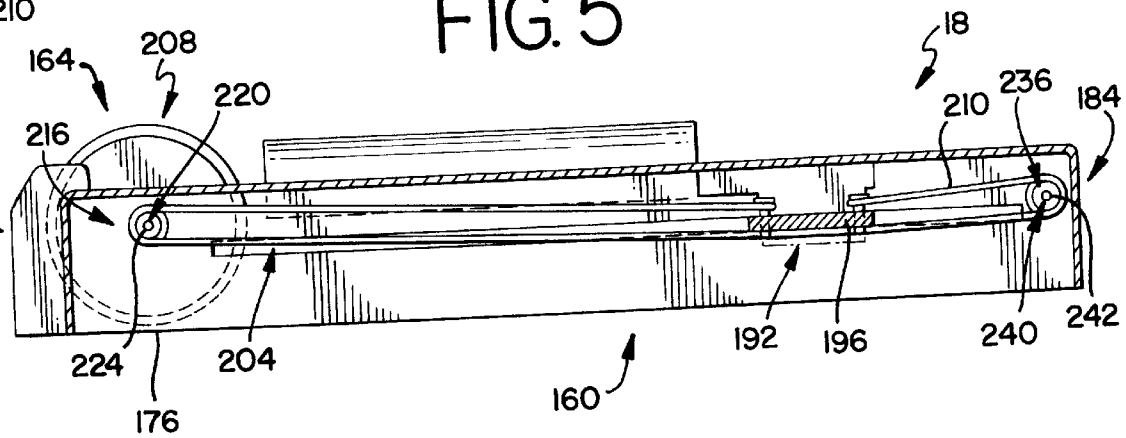
FIG. 5 is a cut away side view along 5—5 of FIG. 1.

Referring again to FIG. 1, the accessory 10 further comprises a saw mill 18. The purpose of the saw mill 18 is to receive a toy log 20 from the dumper station 14 and separate the toy log 20 into two pieces. Referring to FIG. 4, a perspective view of the saw mill 18 is illustrated. The saw mill 18 comprises a mill housing 160, a saw member 164, and a means for providing relative transverse movement to the toy log from one end of the mill housing 160 toward the saw member 164.

The mill housing 160 has opposing sidewalls 172*a*, 172*b*, a closed bottom 176, and an open top 180. The open top 180 is designed to allow a toy log to enter the mill housing 160. Toy logs generally enter the mill housing 160 through the open top 180 at a log receiving end 184. The saw member 164 is positioned within the mill housing 160 at a cutting end 188.

The means for providing relative transverse movement to the toy log from the receiving end 184 toward the cutting end 188 comprises a log pusher 192 connected to a handle 196. The log pusher 192 is initially positioned at the log receiving end 184 of the mill housing 160. The log pusher 192 rides on parallel runners (not shown) positioned adjacent the closed bottom 176 of the mill housing 160. The parallel runners are lengths of rigid material adapted for supporting the log pusher within the housing. The handle 196 is fixedly connected to the log pusher 192 and extends from the mill housing 160 through a lengthwise slot 204 defined by the one of the opposing sidewalls 172*b*. When a toy log enters the mill housing 160, the handle 196 can be moved along the length of the slot 204 toward the cutting end 188 which in turn transfers similar movement to the log pusher 192. The log pusher 192 engages the toy log to move the toy log toward the cutting end 188 and, thus, the saw member 164.

The saw member 164 includes a circular saw blade 208 rotatable about an axis of rotation. The saw blade 208 has an axle 216 extending from either side. The axle 216 engages the mill housing 160 to support the circular saw blade 208 and allow rotational movement by the circular saw blade 208 about the axis of rotation. In the preferred embodiment, the axle 216 has small axle pins 220 extending from either end. The axle pins 220 fit within corresponding small pinholes 224 defined by opposing sidewalls 172*a*, 172*b* of the mill housing 160 to support the circular saw blade 208 within the mill housing 160 and allow the circular saw blade 208 to rotate.

The saw mill 18 further comprises a means for providing rotational movement to the circular saw blade 208. This means for providing rotational movement to the circular saw blade 208 includes a drive belt 210. In the preferred embodiment, the drive belt 210 comprises a strand of string having small springs attached to opposing ends. The springs provide tension to the drive belt 210 and are attached to the handle 196 so that the combination of the drive belt 210 and the handle 196 forms a loop.

The drive belt 210 engages the saw blade axle 216 and a rotatable rear wheel 236 located at the receiving end 184 of the mill housing 160. The rotatable wheel 236 engages the mill housing 160 to support the rear wheel 236 within the housing and to allow rotational movement by the rear wheel 236. Similar to the axle 216, in the preferred embodiment, the rear wheel 236 includes small rear wheel pins 240 on either end which fit within small pinholes 242 defined by opposing sidewalls 172*a*, 172*b*.

In the preferred embodiment, the axle 216 and the rear wheel 236 each have grooved drive wheels 244*a*, 244*b* to accommodate the drive belt 210. The grooved drive wheels 244*a*, 244*b* prevent the drive belt 210 from slipping along the respective lengths of the axle 216 and the rear wheel 236.

The drive belt 210 is further connected to the log pusher/handle assembly. Thus, as the log pusher 192 is activated and moved toward the cutting end 188 of the mill housing 160, the drive belt 210 begins to turn and transfers rotational movement to the circular saw blade 208.

The saw mill 18 further comprises a means for producing a saw-like sound. This means for producing a saw-like sound includes a plurality of teeth and a clicker 256. The plurality of teeth are generally arranged in alignment with the length of the mill housing 160, and each tooth is oriented such that it is perpendicular to the length of the mill housing 160. The teeth are mounted to the mill housing 160 along the side opposite the drive belt 210.

The clicker 256 is produced from a somewhat flexible material such as a thin metal or polymeric strip. The clicker 256 is attached to the log pusher/handle assembly and engages the plurality of teeth as the log pusher/handle assembly is moved toward the cutting end 188. The saw-like sound is produced as the clicker 256 passes over each tooth. The teeth are arranged so that the sawing sound begins as the toy log engages the circular saw blade 208.

While specific embodiments have been illustrated and described, numerous modifications are possible without departing from the spirit of the invention, and the scope of protection is only limited by the scope of the accompanying claims.

What is claimed is:

1. For a toy vehicle set accessory, a saw mill for separating a toy log, the saw mill, comprising:

a mill housing having a log receiving end and a cutting end;

a presevered toy log adapted to fit within the mill housing, the presevered toy log including a plurality of log segments separably joined along a sectioning plane;

a saw member positioned at the cutting end; and, means for providing relative transverse movement to the presevered toy log from the log receiving end to the cutting end, wherein when the presevered toy log is moved to the cutting end, the presevered toy log contacts and is separated by the saw member.

2. The toy vehicle set accessory of claim 1 wherein the means for providing relative transverse movement is a log pusher positioned within the housing and connected to a handle which extends beyond the mill housing wherein the log pusher engages the presevered toy log and the handle can be traversed toward the cutting end wherein the presevered toy log engages the saw member and is separated along the sectioning plane.

3. The toy vehicle set accessory of claim 2 wherein the saw member is a circular saw blade rotatable about an axis of rotation.

4. The toy vehicle set accessory of claim 3 wherein the circular saw blade includes an axle supported within the mill housing to allow rotational movement by the circular saw blade about the axis of rotation.

5. The toy vehicle set accessory of claim 4 further comprising a drive belt engaging the axle of the circular saw blade and a rear wheel positioned at the receiving end of the mill housing, the drive belt connected to the means for providing relative transverse movement wherein the drive belt provides rotational movement to the circular saw blade as the means for providing relative transverse movement transports the presevered toy log from the receiving end toward the cutting end.

6. The toy vehicle set accessory of claim 5 further comprising a means for providing a saw-like sound.

7. The toy vehicle set accessory of claim 6 wherein the means for providing a saw-like noise comprises a plurality of teeth connected to the housing and a clicker joined to the means for providing relative transverse movement wherein the clicker operatively engages the teeth to produce a sawing sound as the presevered toy log engages the saw member.

8. The toy vehicle accessory of claim 1 further comprising a dumper station positioned adjacent the mill housing, the dumper station including a pivotable track portion in parallel alignment with the saw mill and rotatable about a pivot axis which is displaced from the pivotable track portion.

9. The toy vehicle accessory of claim 8 wherein the dumper station further includes a first plate and a beam member connecting the first plate with the pivotable track portion wherein movement provided to the first plate is transferred to the pivotable track portion.

10. The toy vehicle set accessory of claim 9 further comprising a delivery ramp positioned between the saw mill and the pivotable track portion for transferring cargo from a first toy vehicle to the saw mill.

11. The toy vehicle set accessory of claim 9 wherein the dumper station further comprises a toy vehicle ramp for connecting the dumper station to an adjacent toy vehicle track segment.

12. The toy vehicle set accessory of claim 9 wherein a second plate is interconnected to the first plate.

13. The toy vehicle set accessory of claim 12 wherein the beam member comprises a proximal arm substantially parallel to a distal arm, the proximal arm and distal arm connected at a first end to the pivotable track portion, at an intermediate segment to the first plate, and at a second end to the second plate.

14. The toy vehicle set accessory of claim 13 wherein the first plate and the second plate are triangular shaped, each triangular shaped plate having three corners, the first ends of the proximal and distal arms are connected to a leading edge and a trailing edge of the pivotable track portion, respectively, the intermediate segments of the proximal and distal arms are connected to corners of the first plate, the second ends of the proximal and distal arms are connected to corners of the second plate wherein as a rotational movement is provided to the second plate a similar rotational motion is transferred to the pivotable track portion.

15. The toy vehicle set accessory of claim 13 wherein the first and second plates are rotationally attached to a dumper station housing and the first end of the proximal and distal arms are connected to a leading edge and a trailing edge of the pivotable track portion, respectively, the intermediate segments of the proximal and distal arms are connected to the first plate, the second ends of the proximal and distal arms are connected to the second plate wherein as a rotational movement is provided to the second plate relative to the dumper station housing, the track segment is rotated about the pivot axis.

* * * * *